US006505678B2

(12) United States Patent
Mertins

(10) Patent No.: US 6,505,678 B2
(45) Date of Patent: Jan. 14, 2003

(54) CERAMIC CORE WITH LOCATORS AND METHOD

(75) Inventor: Michael Wayne Mertins, Wichita Falls, TX (US)

(73) Assignee: Howmet Research Corporation, Whitehall, MI (US)

( * ) Notice: Subject to any disclaimer, the term of this patent is extended or adjusted under 35 U.S.C. 154(b) by 0 days.

(21) Appl. No.: 09/837,547

(22) Filed: Apr. 17, 2001

(65) Prior Publication Data

US 2002/0148589 A1 Oct. 17, 2002

(51) Int. Cl.[7] ..... B22C 9/00; B22C 9/10; B22C 7/00

(52) U.S. Cl. ..... 164/516; 164/361; 164/369; 164/340; 164/397; 164/45

(58) Field of Search ..... 164/229, 230, 164/231, 340, 397, 361, 369, 516, 35, 45

(56) References Cited

U.S. PATENT DOCUMENTS 4,283,835 A * 8/1981 Obrochta et al. ..... 164/159
4,289,191 A * 9/1981 Myllymaki ..... 164/230
4,417,381 A * 11/1983 Higginbotham ..... 164/35
4,732,204 A * 3/1988 Tabardin ..... 164/35
4,842,243 A 6/1989 Butler ..... 249/124
4,975,041 A 12/1990 Fries et al. ..... 425/547
5,063,992 A * 11/1991 Mrdjenovich et al. ..... 164/34
5,296,308 A 3/1994 Caccavale et al. ..... 428/586
5,350,002 A 9/1994 Orton ..... 164/24
5,370,522 A 12/1994 Lindner ..... 425/546
5,464,342 A 11/1995 Marik et al. ..... 425/533
5,547,630 A 8/1996 Schmidt ..... 264/297.2
5,587,116 A 12/1996 Johnson et al. ..... 264/1.25
5,651,409 A 7/1997 Sheehan ..... 164/412
5,843,494 A 12/1998 Richardson ..... 425/468
5,908,643 A 6/1999 Yost et al. ..... 425/186
5,945,141 A 8/1999 Shirota et al. ..... 425/563
6,065,954 A 5/2000 McFerrin et al. ..... 425/144
6,071,363 A 6/2000 O'Connor et al. ..... 148/559

* cited by examiner

*Primary Examiner*—M. Alexandra Elve
*Assistant Examiner*—Kevin McHenry

(57) ABSTRACT

Method and apparatus for providing a plurality of locator elements on a ceramic core involves placing a ceramic core in a die cavity of die, positioning a plurality of pins in the die cavity with each pin having a locator-forming cavity on an inner end facing a surface of the core, and introducing melted wax into each locator-forming cavity to form a plurality of locator elements on the surface of the core.

25 Claims, 7 Drawing Sheets

CERAMIC CORE WITH LOCATORS AND METHOD

FIELD OF THE INVENTION

The present invention relates to a ceramic core for use in casting molten metallic materials having locator elements formed thereon as well as a method of forming locator elements on cores.

BACKGROUND OF THE INVENTION

Most manufacturers of gas turbine engines are evaluating advanced investment cast turbine airfoils (i.e. turbine blade or vane) which include intricate air cooling channels to improve efficiency of airfoil internal cooling to permit greater engine thrust and provide satisfactory airfoil service life. Internal cooling passages are formed in the cast airfoils using one or more thin airfoil shaped ceramic cores positioned in a ceramic shell mold where the molten metal is cast in the mold about the core. After the molten metal solidifies, the mold and core are removed to leave a cast airfoil with one or more internal passages where the cores formerly resided.

The ceramic core is typically made using a plasticized ceramic compound comprising ceramic flour, organic thermosetting and/or thermoplastic binder and various additives. The ceramic compound is injection molded or transfer molded at elevated temperature in a core die or mold. When the green (unfired) core is removed from the die or mold, it typically is placed between top and bottom setters to cool to ambient temperature before core finishing and gauging operations and firing at an elevated sintering temperature.

The finished fired core is placed and accurately located in a pattern die cavity in which a wax pattern material is introduced about the core to form a core/pattern assembly for use in the well known lost wax investment casting process. In particular, the core/pattern assembly is repeatedly dipped in ceramic slurry, drained of excess slurry, stuccoed with coarse ceramic stucco or sand particles and dried to build up multiple ceramic layers that collectively form a shell mold about the assembly. The pattern then is selectively removed to leave a shell mold with the ceramic core therein.

An attempt to accurately position the ceramic core in the pattern die cavity has involved gluing plastic locators on the convex and concave airfoil surfaces of the core such that the locators will engage the wall of the pattern die cavity and positively locate the core therein. This technique is disadvantageous in that it involves a manual assembly operation that is time consuming and requires gluing. This technique also is disadvantageous in that it is subject to variations in application of the core locators on the ceramic core whereby the positions of the locators may vary from one core to the next as a result of the manual nature of the operation.

An object of the invention is to provide method and apparatus for providing locators on a ceramic core for use in casting molten metallic materials in a manner that overcomes the above disadvantages.

SUMMARY OF THE INVENTION

The present invention provides method and apparatus for forming locator elements on a ceramic core wherein a ceramic core is placed in a die cavity having a plurality of locator-forming cavities proximate the core, and a fluid material, such a melted wax, is introduced into each locator-forming cavity to form a plurality of locator elements on a surface of the core.

In one illustrative embodiment of the invention, method and apparatus for providing a plurality of locator elements on a ceramic core involves placing a ceramic core in a die cavity of die, providing a plurality of pins in the die cavity with each pin having a locator-forming cavity on an inner end proximate the core, and introducing a fluid material, such as for example melted wax, into each locator-forming cavity to form a plurality of locator elements on the surface of the core.

In a particular embodiment, each locator-forming cavity of a respective pin is communicated to a melted wax supply passage on the die for supplying the melted wax or other fluid material thereto. The die cavity includes die cavity surface regions that provide positive core location while the locator elements are being molded thereon. For example, die cavity surfaces are provided proximate the pins and configured to provide a controlled limited clearance between the core and the die cavity surfaces for positive core location and to prevent the melted wax or other fluid material from flowing between such die cavity surfaces and the core surfaces.

In an another embodiment of the invention useful for practice with an airfoil shaped core, a plurality of the pins face a concave airfoil core surface and another plurality of the pins face a convex surface core surface to form locator elements on the concave and convex airfoil core surfaces. The pins are threadably adjustable on the die to position the pins relative to different core airfoil shapes to permit the height of the locator elements to be tuned to core measurements determined to provide finished casting blueprint specifications.

The invention provides a ceramic core having a plurality of locator elements molded thereon to provide for positive location of the core in a pattern forming die.

The invention is beneficial for, although not limited to, forming locator elements on airfoil shaped ceramic cores used in the casting of gas turbine airfoils such as turbine blades and vanes especially where the core is a relatively long and thin walled ceramic core. Other objects and advantages of the invention will become more apparent from the following detailed description taken with the following drawings.

DESCRIPTION OF THE INVENTION

The present invention is described herebelow for purposes of illustration only with respect to a ceramic core for use in casting a nickel or cobalt base superalloy gas turbine engine blade where the core forms a cooling passage in the cast blade when the core is removed. The invention is not so limited can be practiced with respect to other ceramic cores to make a variety of castings for other applications from a variety of metals and alloys.

Figure 1:
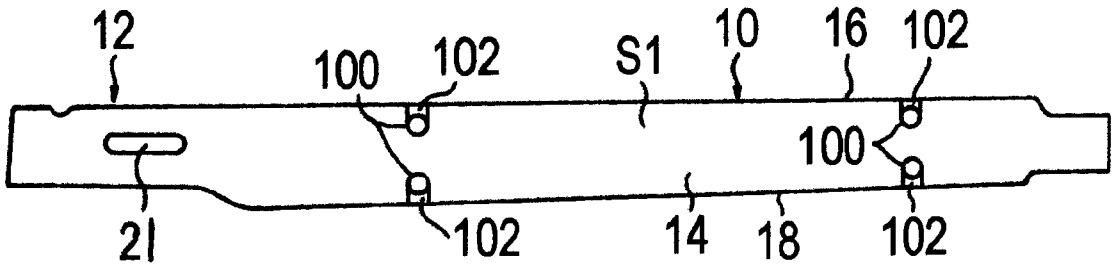
FIG. 1 is an elevational view of an airfoil shaped ceramic core on which locator elements have been formed pursuant to the invention.

An illustrative fired ceramic core 10 for use in casting a nickel or cobalt base superalloy gas turbine engine blade is illustrated in FIG. 1. The core 10 has a configuration of an internal cooling passage to be formed in the turbine blade casting. The core 10 is illustrated as comprising a root region 12 and an airfoil region 14. The airfoil region 14 includes a leading edge 16 and a trailing edge 18. Opening or slot 21 is provided in the core in the event the design of the finished casting calls for an internal casting feature formed by such slot. Some cores may not include such an opening or slot 21.

The core 10 includes a convex side S1 and an opposite concave side S2 as is well known in the turbine airfoil core art.

The core 10 can be made by conventional injection molding, transfer molding, or other core-forming techniques where a plasticized ceramic compound is introduced into a core die or mold. An injection or transfer molded ceramic core is molded by injecting the ceramic compound including ceramic powder (e.g. alumina, silica, zircon, zirconia, etc. fluor), an organic binder (e.g. a thermosetting binder material, thermoplastic or cross-linking thermoplastic binder material, and mixtures thereof) and various additives at elevated temperature into a die at superambient die temperature to form a green core, which is then fired or sintered to produce a porous, fired ceramic core of adequate strength for casting molten metal or alloy as is well known.

Figure 3:
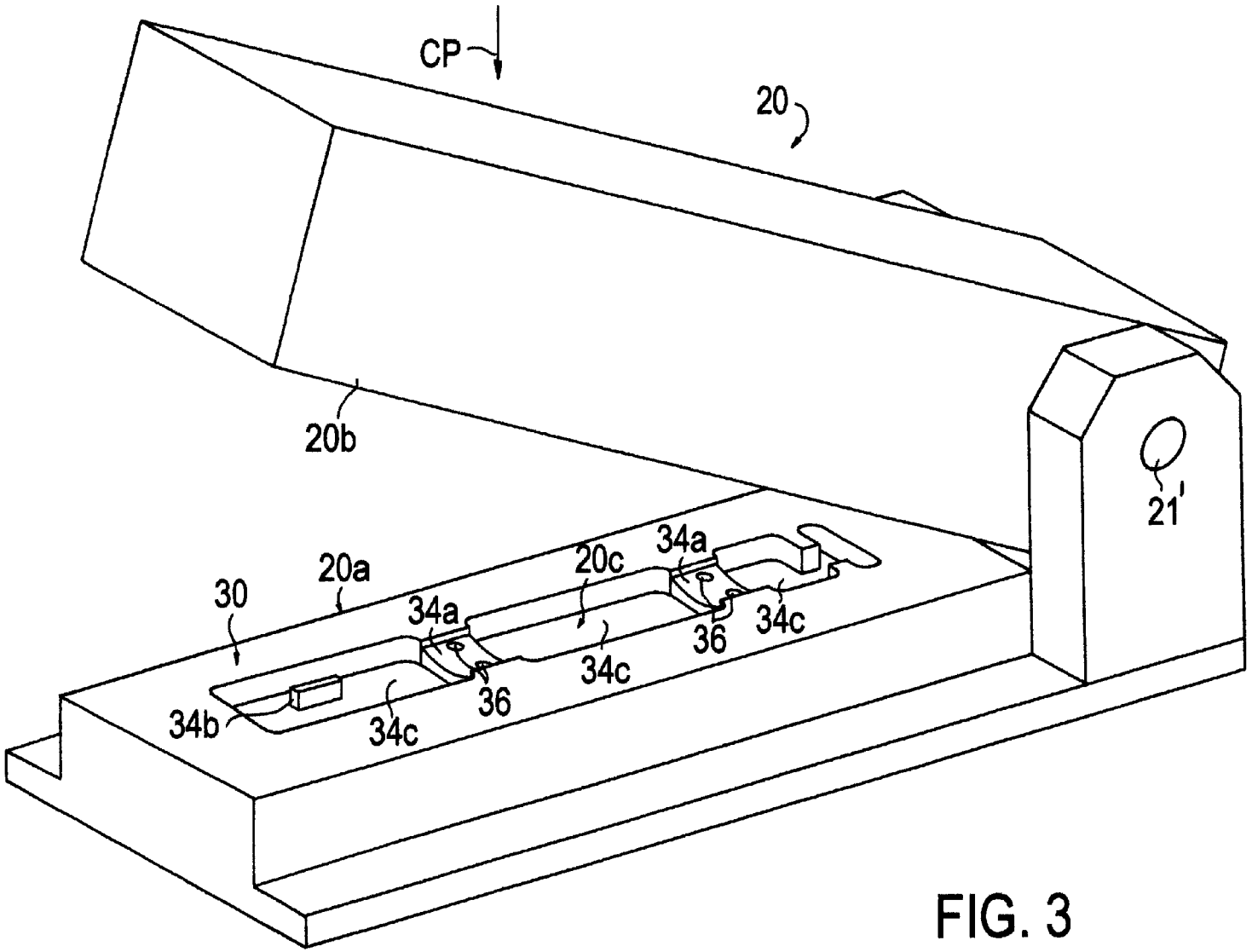
FIG. 3 is a schematic perspective view of locator-forming die having a lower section and upper section, the lower and upper die sections being shown in more detail in FIGS. 3A and 3B.
Figure 4:
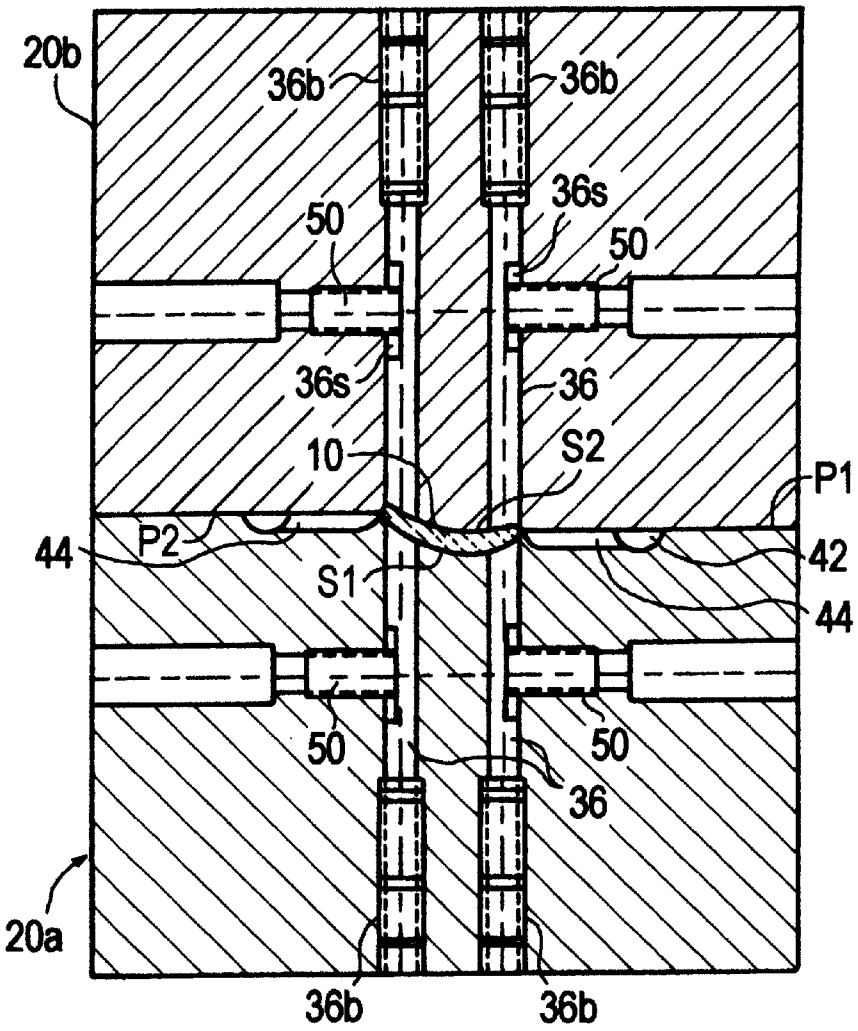
FIG. 4 is a sectional view of the lower die section taken along lines 4—4 of FIG. 3A.
Figure 5:
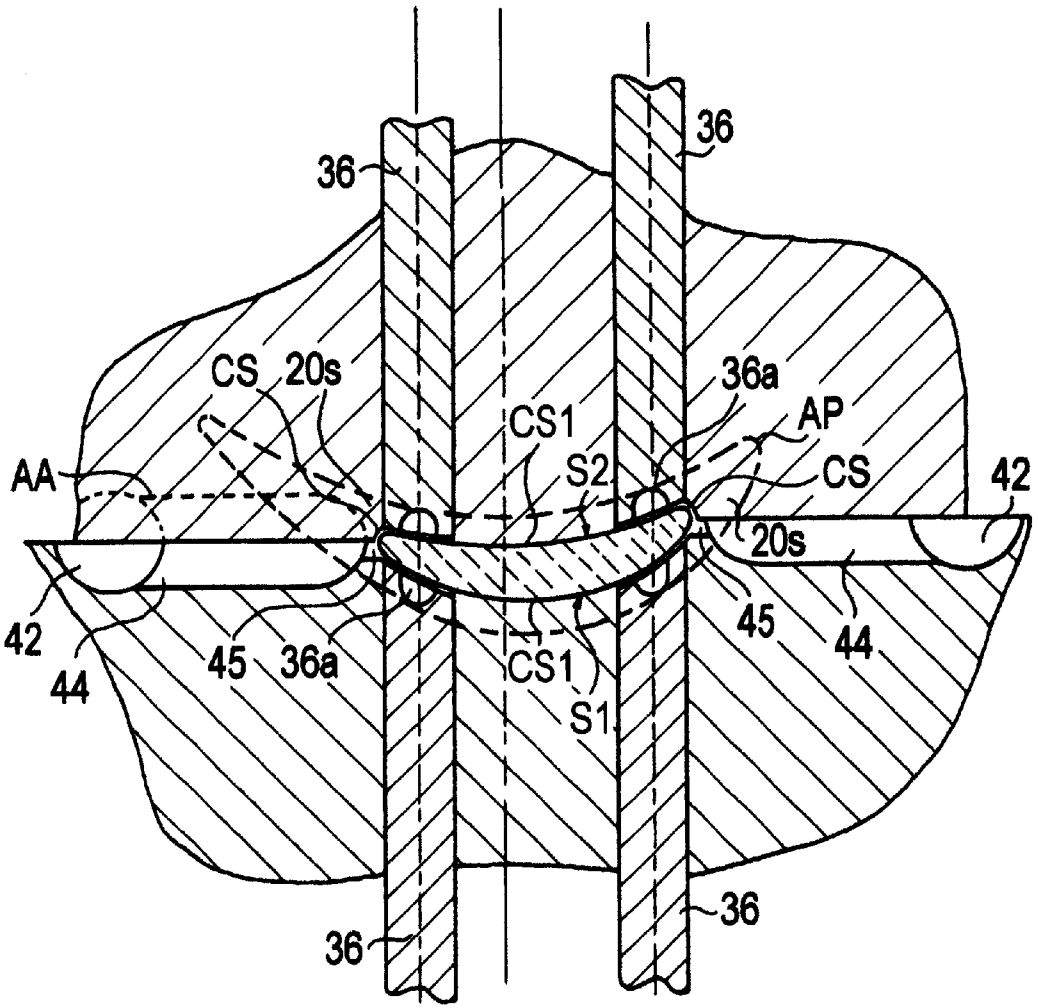
FIG. 5 is sectional view of the lower die section taken along lines 5—5 of FIG. 3A.

Referring to FIGS. 3–5, apparatus for forming locator elements on the ceramic core 10 is illustrated. The apparatus includes a die 20 having an lower section 20*a* and upper section 20*b* hinged together by pin 21' at one end and clampable together during wax injection using a 35 ton clamping press mechanism shown schematically by arrow CP.

Figure 3A:
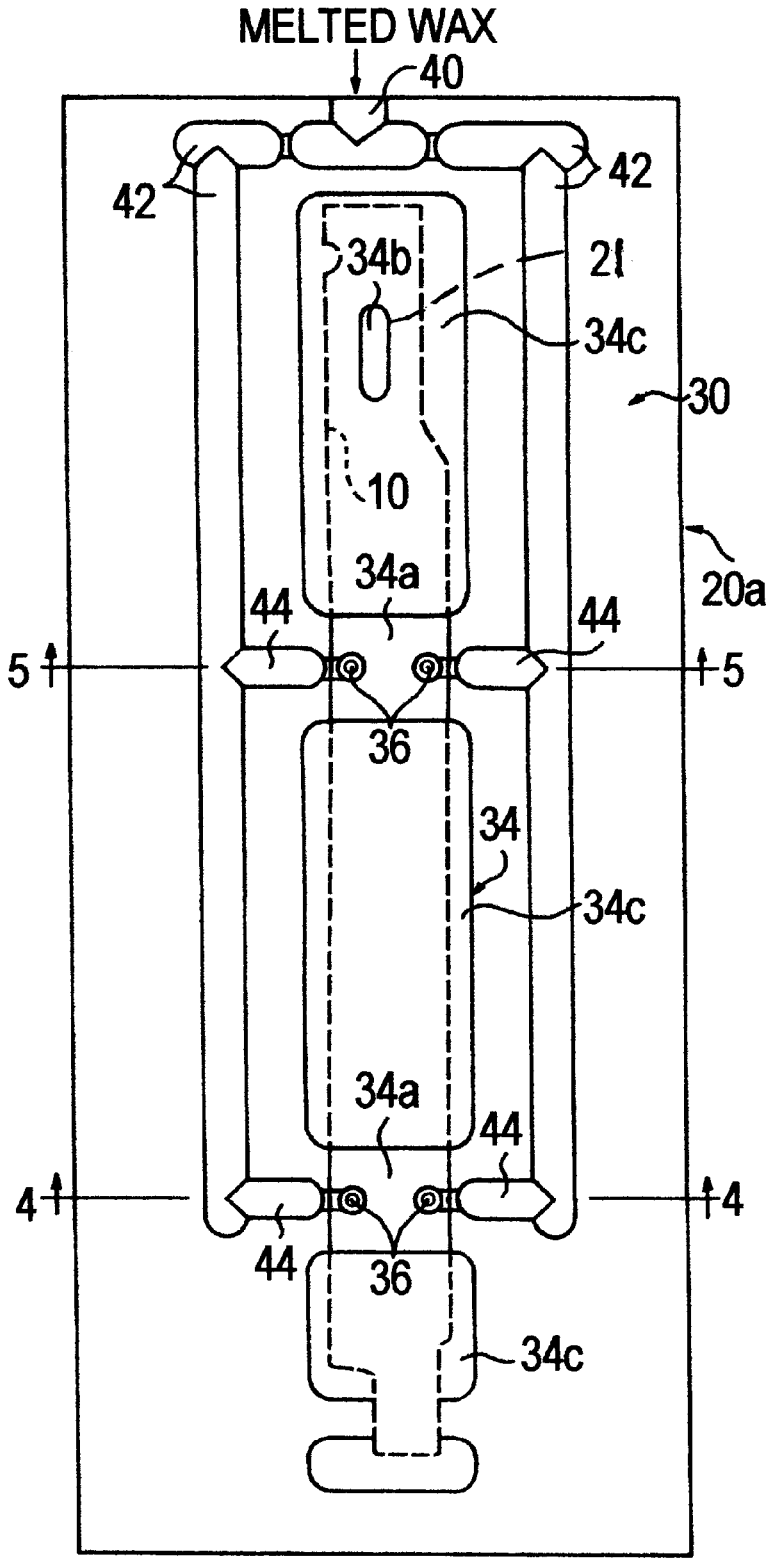
FIG. 3A is a plan view of the lower die section.
Figure 3B:
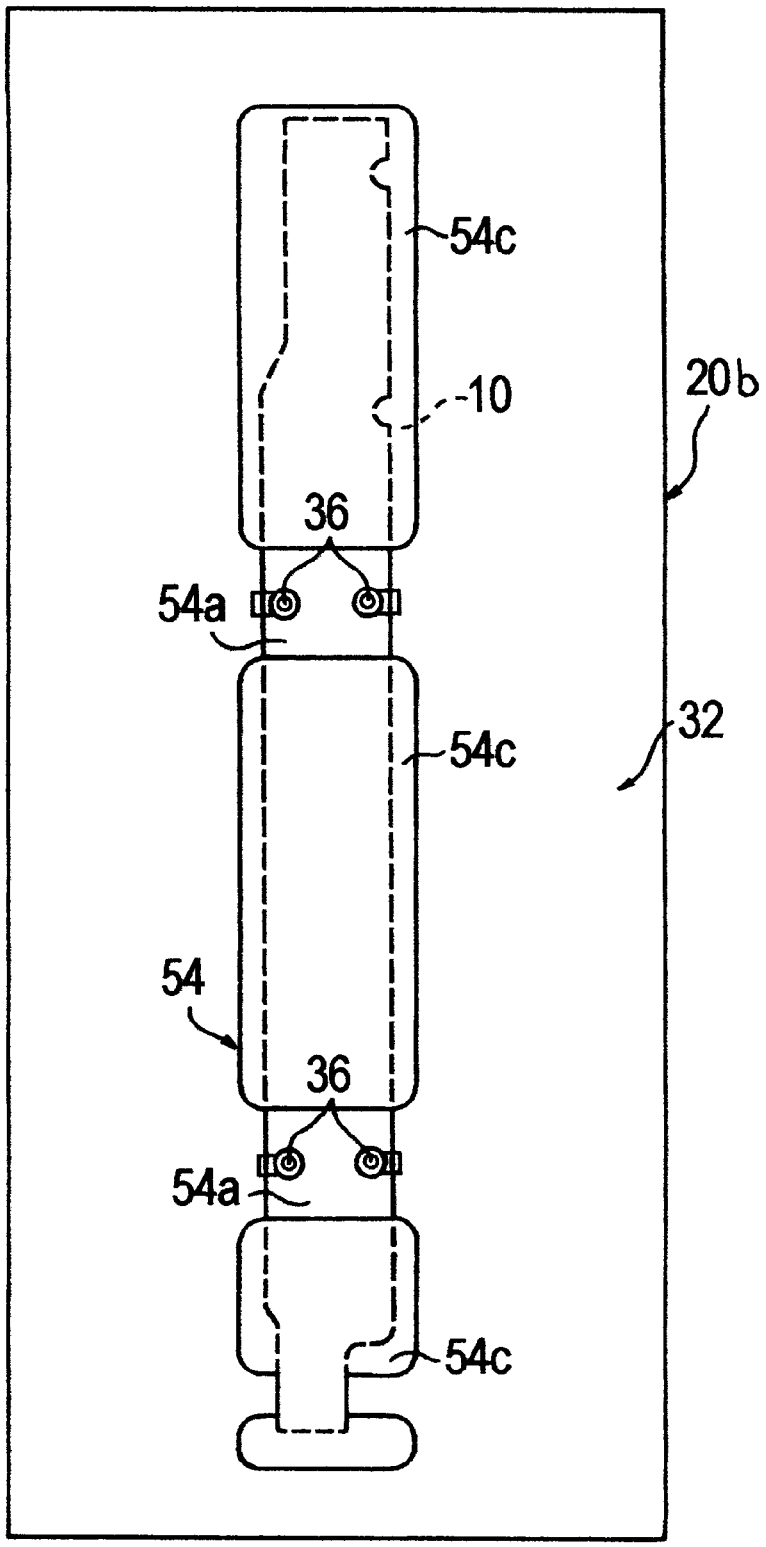
FIG. 3B is a plan view of the upper die section.

The upwardly facing surface 30 of the lower die section 20*a* is shown in FIG. 3A and the downwardly facing surface 32 of the upper die section 20*b* is shown in FIG. 3B. When the die sections 20*a*, 20*b* are clamped together, surfaces 30, 32 form a fluid-tight seal and define a die cavity 20*c* therebetween to receive the core 10, FIGS. 4 and 5.

The upwardly facing surface 30 of lower die section 20*a* includes an elongated recessed die cavity 34 having a pair of raised die cavity surfaces 34*a* which include a pair of upstanding elongated pins 36, which typically are cylindrical pins having a diameter of 0.25 inch, although any shape and dimension of the pins can be used as appropriate. Each pin 36 includes an inner end proximate the core 10 with the inner end having a recessed locator-forming cavity 36*a* that is adapted to be disposed adjacent and facing the convex core surface S1, FIG. 5, to form locator elements thereon. Each pin 36 includes a threaded outer end 36*b* threaded into a bore in the lower die section 20*a* so that each pin 36 is movable axially toward and away from the horizontal planes P1, P2 of the die sections 20*a*, 20*b* in a bore in the upper die section 20*a*. The surface 30 also includes a raised elongated rib 34*b* that is received in slot 21 in the core 10 for purpose of core location in the die 20.

The lower die section 20*a* also includes an inlet 40 for receiving melted wax of the type used to subsequently form the pattern about the core 10, under pressure from a source, such as an injection ram of a conventional wax injection machine. The invention is not limited to use of melted wax as the fugitive material to form the locator element since other materials, such as for example only plastic polymers also used in the lost wax process, can be employed.

The inlet 40 communicates to a pair of elongated supply passages 42 machined in the lower die section 20*a*, FIGS. 3B, 4 and 5. Each passage 42 communicates to lateral passages 44 that extend in a direction normal to the respective passage 42 and to the longitudinal axis of the core 10 as shown best in FIG. 3A. Each passage 44 supplies melted wax or other fluid material for the locator elements under pressure (e.g. 300 psi) to the locator-forming cavity 36*a* of the proximate pin 36 as shown best in FIG. 3B. In particular, each passage 44 communicates to a small lateral passage 45 that communicates to the locator-forming cavity 36*a* of each pin by a clearance space CS between the inner end of each pin 36 and the adjacent core surface S1 or S2. The clearance space CS is provided between the upper die section 20*b* and the core at upper die regions 20*s*. The invention envisions providing a counterpart to passages 42 and 44 in upper die section 20*b* as illustrated by dashed lines AA in FIG. 5 to provide melted wax to a counterpart passage (not shown) in the upper die section to passage 45 (in the lower die section) in the event that increased wax flow is needed to the upper pins 36. Thus, the upper die section would include a passages like passages 42, 44 and 45.

The downwardly facing surface 32 of upper die section 20*b* includes an elongated recessed die cavity 54 having a pair of die cavity surfaces 54*a* which are similar to surfaces 34*a* and which include a pair of pins 36 like the pins in the lower die section 20*a*. The pins 36 in the upper and lower die sections are coaxial as is apparent in FIG. 5. Each pin 36 in the upper die section includes an inner end proximate the core 10 with the inner end having a recessed locator-forming cavity 36*a* adapted to be disposed adjacent and facing the concave core surface S2, FIG. 5, to form locator elements thereon. Each pin 36 includes a threaded outer end 36*b* threaded into a bore in the upper die section 20*b* so that each pin 36 is movable axially toward and away from the horizontal planes P1, P2 of the die sections 20*a*, 20*b* in a bore in the upper die section 20*b*.

The pins 36 in the lower and upper die sections are prevented from rotation by elongated lateral keys 50 threaded into the die sections 20*a*, 20*b* to engage in slots 36*s* of each pin 36 as shown best in FIG. 4.

The die cavity surfaces 34*a*, 54*a* of the lower and upper die sections 20*a*, 20*b* are configured to positively locate the core 10 in the die cavity 20*c* while the locator elements are being molded on the core surfaces S1, S2. To this end, there is provided a limited close clearance space CS1 between die cavity surfaces 34*a*, 54*a* and the core surfaces S1, S2 that positively locates the core 10 in the die cavity 20 while providing a wax-tight sealing action preventing the melted wax from flowing into the clearance space. For a typical molten pattern wax, the clearance between surfaces 34*a*, 54*a* and cores surfaces S1, S2 is 0.010 inch or less to this end. Die surfaces 30, 32 also have this wax-tight clearance space of 0.010 inch or less.

Regions of the core 10 span across enlarged die cavities 34*c* in the lower die section 20*a* and enlarged die cavities 54*c* in the upper die section. The cavities 34*c*, 54*c* are machined out of the die sections 20*a*, 20*b* and take no part in locating the core in the die 20.

The inner ends of pins 36 in the lower die section 20*a* are disposed adjacent and facing the convex core surface S1 when the die sections 20*a*, 20*b* are clamped together, FIG. 5. The inner ends of pins 36 in the upper die section 20*b* are disposed adjacent and facing the concave core surface S2 when the die sections 20*a*, 20*b* are clamped together. The inner ends of the pins 36 are spaced from the core surfaces S1, S2 by the clearance space CS (e.g. 0.035 inch) to allow melted wax material to flow from passages 44, 45 into the locator-forming cavity 36*a* of each pin 36 to solidify therein to form raised locator elements 100 on and attached to the core surfaces S1, S2 as shown in FIG. 1 and 5.

Figure 6:
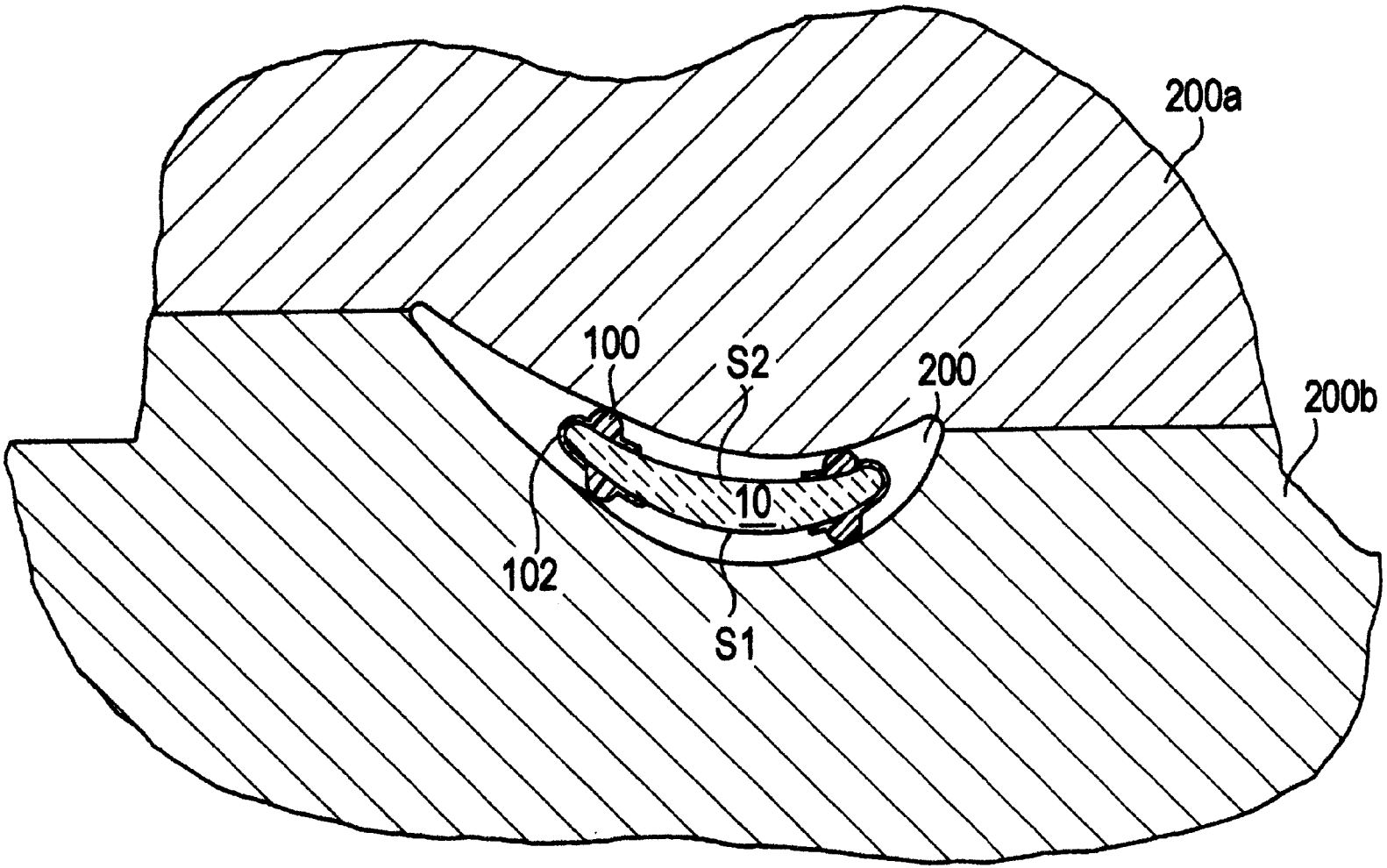
FIG. 6 is a partial sectional view of a pattern forming die with a ceramic core having the locator elements positioned in the die.

The locator elements 100 can have any suitable shape that can be used to position the core 10 in a pattern forming die cavity where a wax airfoil pattern is formed about the core 10, FIG. 6. The locator elements 100 are illustrated as having a partial spherical shape whose outer radius is generally tangent to a line defining the thickness of the wax airfoil pattern to be formed on the core 10 in the pattern forming die cavity. The thickness of the wax airfoil pattern is indicated by the dashed line AP in FIG. 5.

After the molten wax has solidified in the locator-forming cavity 36*a* of each pin, the clamping pressure is released and the die sections 20*a*, 20*b* are opened about hinge pin 21' and the core 10 with multiple locator elements 100 molded thereon, FIG. 1, is removed from the lower die cavity surface. Each locator element .100 molded on the concave side S1 of the core 10 is connected to the underlying locator element 100 molded on the convex side S2 by a thin layer or tab 102 of solidified wax that wraps around the proximate leading edge 16 and trailing edge 18 of the core 10 as shown in FIG. 1 and 6. The solidified wax in each passage 45 breaks off at a location between the thin tab 102 and the lateral passage 44 when the core is removed from the die 20.

Figure 2:
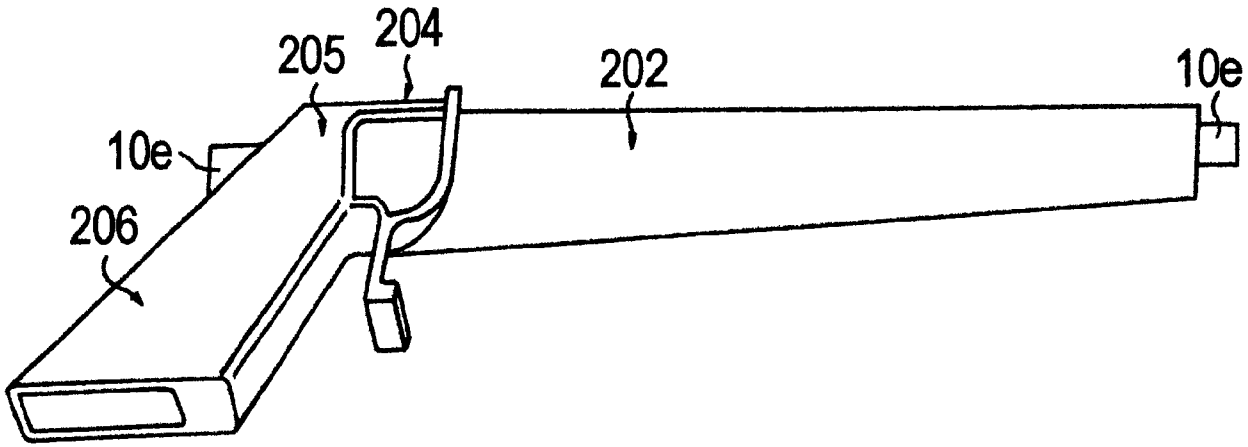
FIG. 2 is a perspective view of the airfoil shaped ceramic core after a wax pattern of a gas turbine blade has been injection molded thereabout.

The core 10 then is placed and accurately positioned in a conventional pattern forming die cavity 200 using the molded-on locator elements 100. For example, the core 10 is accurately positioned in the pattern forming die cavity 200 formed between upper and lower pattern die sections 200*a*, 200*b* by the locator elements 100 engaging the walls of the pattern forming die cavity, FIG. 6. Hot melted wax is injected under pressure into the cavity 200 about the core 10 and solidified to form a wax turbine blade pattern about the core 10 in conventional manner. The turbine blade pattern includes an airfoil portion 202, a platform portion 204, root portion 205, and gating 206. FIG. 2 shows a typical wax gas turbine blade pattern injection molded about the core 10 with the exception of exposed ends loe of the core 10, which function as core prints for locking the core in the ceramic shell mold subsequently formed about the core/pattern assembly by the well known lost wax process.

It will be apparent to those skilled in the art that variations can be made in the embodiments of the invention described without departing from the scope of the invention set forth in the claims.

I claim:

1. A method of forming locator elements on a ceramic core, comprising placing a ceramic core in a die cavity having a plurality of locator-forming cavities proximate said core, and introducing a fluid material into each locator-forming cavity to form a plurality of locator elements on said core for locating said core in a pattern forming die cavity.

2. The method of claim 1 wherein said fluid material is melted wax.

3. A method of forming locator elements on a ceramic core, comprising placing a ceramic core in a die cavity having a plurality of pins with each pin having a locator-forming cavity on an inner end proximate said core, and introducing a fluid material into each locator-forming cavity to form a plurality of locator elements on a surface of the core.

4. The method of claim 3 wherein said fluid material comprises melted wax and is introduced into the locator-forming cavities and solidified to form said locator elements.

5. The method of claim 3 including communicating each locator-forming cavity of a respective pin to a passage that supplies said fluid material thereto.

6. The method of claim 3 wherein said die cavity includes a die cavity surface about each said pin and configured to locate said core while said locator elements are being formed thereon.

7. The method of claim 6 wherein said die cavity surface is configured to provide a limited clearance between said core and said die cavity surface effective to prevent said fluid material from flowing into said clearance.

8. The method of claim 7 wherein said clearance is 0.010 inch or less.

9. The method of claim 3 wherein said core includes a concave airfoil surface facing a plurality of said pins in a first die section and a convex surface core surface facing a plurality of said pins in a second die section.

10. The method of claim 3 including threadably adjusting the position of said pins relative to said core.

11. Apparatus for forming locator elements on a ceramic core, comprising a die cavity, a plurality of pins in the die cavity with each pin having a locator-forming cavity on an inner end proximate said core, each said locator-forming cavity facing a surface of the core, and a passage for introducing a fluid material into a respective locator-forming cavity to form a plurality of locator elements on the surface of the core.

12. The apparatus of claim 11 wherein said die comprises an upper section and lower section, some of said pins being disposed on said upper section and other of said pins being disposed on said lower section.

13. The apparatus of claim 11 wherein said die cavity includes a die cavity surface about each said pin configured to locate said core while said locator elements are being formed thereon.

14. The method of claim 13 wherein said die cavity surfaces are configured to provide a limited clearance between said core and said die cavity surface effective to prevent said fluid material from flowing into said clearance.

15. The apparatus of claim 14 wherein said clearance is 0.010 inch or less.

16. The apparatus of claim 11 wherein said die cavity includes a concave airfoil surface and a convex airfoil surface.

17. The apparatus of claim 16 wherein a plurality of said pins are disposed on said concave airfoil surface and another plurality of said pins are disposed on said convex airfoil surface to face a respective concave airfoil surface of said core and a convex airfoil surface of said core.

18. The apparatus of claim 11 including threadably adjusting the position of said pins relative to said core.

19. A ceramic core for use in casting an airfoil, comprising a concave core surface and a convex core surface, connected by a leading edge and trailing edge, a first locator element molded on the concave surface of a fugitive material and a second locator molded on the convex core surface of said fugitive material, said first and second locators being connected by a strip of the fugitive material molded on the concave and convex core surfaces and wrapping around at least one of the leading edge and the trailing edge.

20. The core of claim 19 wherein the first locator and the second locator element are are disposed in a common plane.

21. The core of claim 19 wherein said fugative material is wax.

22. A method of forming locator elements on a ceramic core having a concave surface and convex surface, comprising placing a ceramic core in a die cavity having a plurality of locator-forming cavities adjacent said concave surface and adjacent said convex surface, and introducing a fluid material into the locator-forming cavities where said material solidifies to form a plurality of locator elements on said concave surface and on said convex surface for locating said core in a pattern forming die cavity.

23. A method of forming a pattern on a ceramic core, comprising placing a ceramic core in a die cavity having a plurality of locator-forming cavities proximate said core, introducing a material into each locator-forming cavity to form a plurality of locator elements on said core, positioning said core in a pattern forming die cavity by engaging said locator elements with a wall of said pattern forming die cavity, and introducing a pattern material into said pattern forming die cavity.

24. The method of claim 23 wherein said core has an airfoil shape and said locator elements are formed on a concave side and on a convex side of said airfoil shape core.

25. A ceramic core having a concave side and convex side for use in casting an airfoil, comprising a first locator element molded of a fugitive material on said concave side and a second locator element molded of the fugitive material on said convex side.

* * * * *